United States Patent [19]

Dahlgren

[11] Patent Number: 4,961,964

[45] Date of Patent: Oct. 9, 1990

[54] METHOD FOR COATING A WEB WITH WET INK THEREON

[75] Inventor: Harvey W. Dahlgren, Irving, Tex.

[73] Assignee: Epic Products International Corp., Dallas, Tex.

[21] Appl. No.: 313,733

[22] Filed: Feb. 22, 1989

Related U.S. Application Data

[62] Division of Ser. No. 066,479, Jun. 26, 1987, Pat. No. 4,836,129.

[51] Int. Cl.[5] ..... B05C 1/08

[52] U.S. Cl. ..... 427/211; 427/428; 118/46; 118/227; 101/483

[58] Field of Search ..... 427/211, 428; 101/483, 101/416.1, 424.2; 118/46, 70, 226, 227, 262, 210, DIG. 15

[56] References Cited

U.S. PATENT DOCUMENTS

| | | | |
|---|---|---|---|
| 1,711,596 | 5/1929 | Grammer | 118/227 |
| 1,933,161 | 10/1933 | Claybourn et al. | 101/422 |
| 2,513,394 | 7/1950 | Barrett et al. | 118/249 |
| 2,970,564 | 2/1961 | Warner | 118/249 |
| 3,000,287 | 9/1961 | Heldens | 118/227 |

*Primary Examiner*—Shrive Beck
*Assistant Examiner*—Alain Bashore
*Attorney, Agent, or Firm*—Burns, Doane, Swecker & Mathis

[57] ABSTRACT

A convertible coating apparatus provides one or two side coating of a web having wet ink thereon to permit both printing and coating to be carried out prior to any drying operation. The apparatus includes a coating applicator roller in contact with a relatively hard back-up roller. The coating applicator roller is supplied with coating in both the one and two side operations while the back-up roller is supplied with coating only in the two side operation. Water is supplied to the back-up roller in the one side operation and the back-up roller has a hydrophilic surface which, when supplied with water, repels the wet ink on the web passing through the couple and prevents smudging and offset of the ink to the back-up roller. A method of carrying out the one and two side coating is also disclosed. A turning roller is also provided which guides the freshly inked web between inking operations without smudging the ink on the web.

7 Claims, 2 Drawing Sheets

Fig. 1
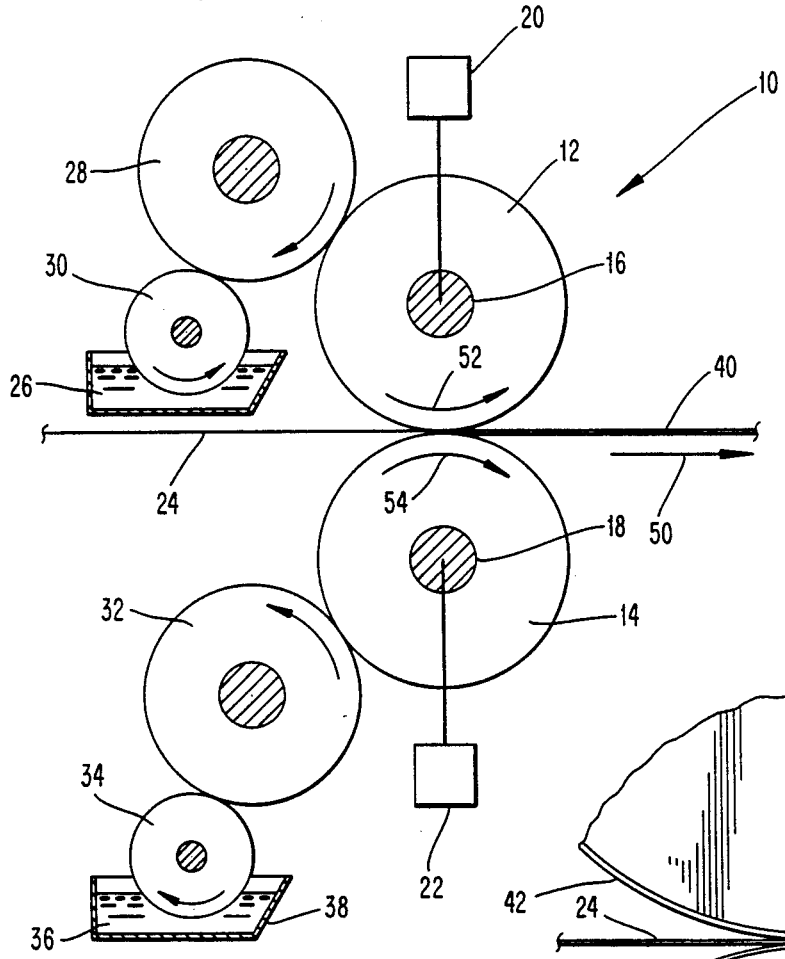
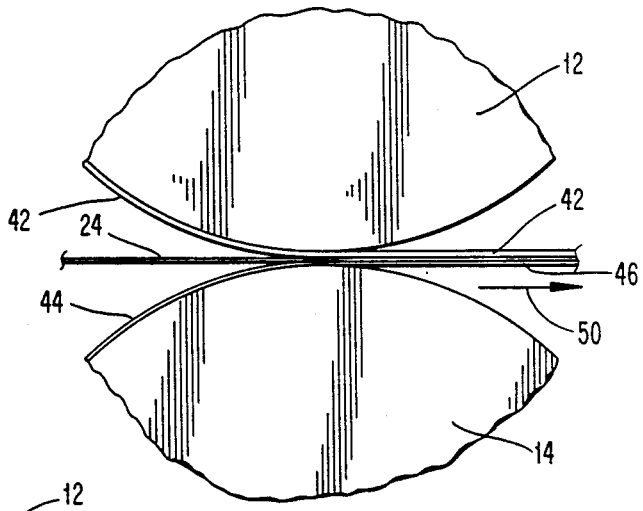
Fig. 2
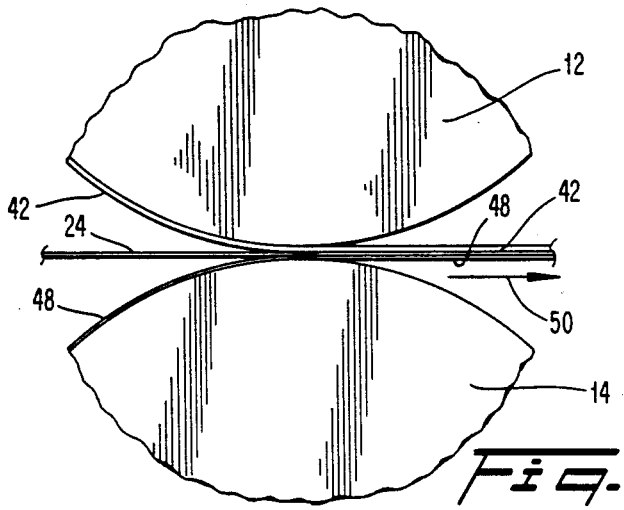
Fig. 3

METHOD FOR COATING A WEB WITH WET INK THEREON

This application is a divisional, of application Ser. No. 07/066,749, filed June 26, 1987, now U.S. Pat. No. 4,836,129.

BACKGROUND OF THE INVENTION

1. Field of the Invention

This invention relates generally to web treating systems and, more particulary, to methods and apparatus for handling and coating of either one or two sides of an inked web.

2. Description of the Prior Art

Coating printed webs provides protection to the printed surface of the web and can enhance the appearance of the printed material on the web by forming a gloss on the surface of the printed surface.

It is conventional to apply such a coating to the printed web after the ink on the web has dried so that there is no concern in known devices regarding smudging or offset of wet ink on the coating rollers. Following coating, the coated web is dried and the printed and coated article is complete.

One disadvantage with such a system is that the web must undergo two drying operations during the process. This involves additional time and expense so that it would be desirable to be able to apply both ink and coating to the web prior to any drying operation so that both the ink and coating could be dried in a single drying operation.

It is known in the prior art that this objective may be achieved in a two side coating system including a rubber coating applicator roller, a rubber back-up roller and means for supplying both of the rollers with coating so that a web passing between the rollers is coated on both sides thereof. However, it has not been possible to adapt this system for use in a one side coating operation since offset and smudging occur at the back-up roller when coating is not being supplied thereto.

There is a need for a coating system which is capable of performing a one or two side coating operation on a web having wet ink on both sides thereof which prevents smudging and offset of the wet ink to the back-up roller.

In addition, there is a further need for a turning roller structure that can be used in either coating or printing operations to guide a freshly inked web into an operation subsequent to printing without a risk of smudging of the ink.

OBJECTS AND SUMMARY OF THE INVENTION

It is an object of the present invention to provide an improved coating apparatus and method for use in conjunction with a printing operation.

It is a further object of the present invention to provide a coating apparatus and method which performs either a one or two side coating operation on a web which has been printed but which has not yet been dried.

Further, it is another object of the present invention to provide a turning roller that can be used, either in the inventive or other coating apparatus or with other types of printers, to guide a freshly inked web into a subsequent operation without smudging the ink on the web.

These and other objects and advantages will be apparent from this written description and appended drawings.

In a preferred embodiment, the coating apparatus of the present invention is capable of use in at least a on side coating operation and may be convertible between a one or two side operation.

The apparatus may include a coating applicator roller having an applicator roller surface made of a relatively soft material such as rubber and a back-up roller forming a couple with the applicator roller and having a back-up roller surface which is hard relative to the applicator roller surface and is hydrophilic. Means are provided for supplying coating to the applicator roller and for supplying either water or coating to the back-up roller depending on whether a one side or two side coating operation is being performed. Drive means are also provided for driving the applicator and back-up rollers and feeding means feed a web having wet ink thereon through the roller couple.

It is preferred that the surface of the back-up roller be formed with a hard chrome finish with a hydrophilic etch. Also, the drive means may be a variable speed drive means capable of driving the applicator and back-up rollers in either direction at any desired speed relative to each other. This enables the rollers to be rotated in a direction opposite to the direction of web travel so as to press the coating into the web in a two side coating operation.

The method employed by a preferred embodiment of the present invention includes the steps of supplying coating to the applicator roller, supplying water to the back-up roller and feeding a web having wet ink thereon between the applicator and back-up rollers so that coating is applied to one side of the web and water on the surface of the back-up roller separates the other side of the web from the back-up roller thus preventing any ink on the web from contacting the back-up roller. The method may further include the steps of changing the supply to the back-up roller from water to coating, supplying coating to the back-up roller and feeding the web between the applicator roller and the back-up roller so that coating is applied to both sides of the web.

By this construction it is possible to perform either a one or two side coating of a freshly printed web which has not yet been dried so that both the ink and coating may be dried together in a single drying operation. This represents a substantial savings in time and expense due to the web undergoing only one drying operation instead of two such operations.

In addition, the inventive apparatus provides a versatile device which may be employed in either a one or two sided coating operation with no modification other than replacement of the supply to the back-up roller and any cleaning which must accompany the change.

Further, since the coating roller is a relatively soft rubber roller as compared with the relatively hard back-up roller, it is possible to compensate for thickness variations which can exist in the paper of a web passing through the apparatus. Pressure variations between the rollers may also be compensated for by this advantageous construction.

The turning roller of the invention consists of a turning roller having a hydrophilic surface, means for supplying water to the hydrophilic surface and means for feeding a web over the turning roller. Wet ink on the web is not transferred to the turning roller since the hydrophilic surface of the roller repels the ink and, therefore, no smudging occurs.

BRIEF DESCRIPTION OF THE DRAWING

The preferred embodiment of the invention is discussed in the following detailed description which should be considered in connection with the figures in the accompanying drawing, in which:

FIG. 1 is a schematic view of a coating apparatus according to a preferred embodiment of the invention, FIG. 2 is an enlarged view of the couple between the applicator roller and the back-up roller of the apparatus shown in FIG. 1 when employed in a one side coating operation, FIG. 3 is an enlarged view of the couple between the applicator roller and the back-up roller of the apparatus shown in FIG. 1 when employed in a two side coating operation.

Similar reference numerals are employed throughout the drawing to refer to similar elements.

DETAILED DESCRIPTION OF THE PREFERRED EMBODIMENT

Figure 4:
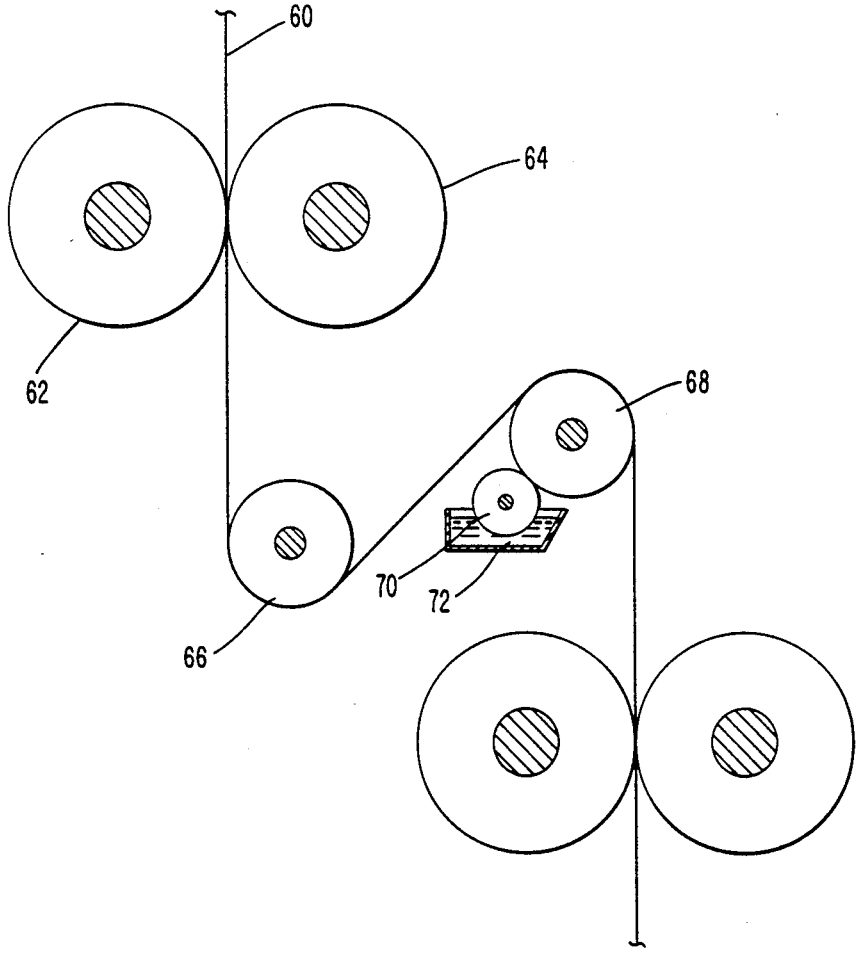
FIG. 4 is a schematic view of a turning roller arrangement according to one embodiment of the invention.

A preferred embodiment of the invention is illustrated in FIG. 1. According to the figure, the apparatus, which is indicated generally by the numeral 10, includes a coating applicator roller 12 which is preferably made of a resilient material such as rubber or has an outer surface of a resilient material such as rubber. The coating applicator roller 12 forms a roller couple with a back-up roller 14 which is a hydro-dynamic roller with a hard surface relative to the applicator roller 12. The back-up roller 14 preferably has a hydrophilic surface such as a hard chrome finish with a hydrophilic etch so that the back-up roller has an affinity for water.

The applicator and back-up rollers 12 and 14 are supported on suitable support shafts 16 and 18 and drive means referenced at 20 and 22 are connected to the shafts for rotating the rollers 12 and 14 during a coating operation. The drive means 20 and 22 may be of any known type and preferably are of a type having variable speeds so that the rollers 12 and 14 may be rotated at a suitable following speed to a printing press with which the coating apparatus 10 is employed. Although the rollers 12 and 14 may be driven at different speeds from one another, in the preferred embodiment, the rollers are driven at the same speed. A suitable pressure exists between the applicator roller 12 and the back-up roller 14 and is adjustable in a known manner to permit the couple to provide an optimum coating of a web 24. The pressure is applied to the rollers 12 and 14 through the support shafts 16 and 18.

A coating is supplied to the coating applicator roller 12 from a coating supply source 26 through a first intermediate roller 28 interposed between the applicator roller and a dipping roller 30. The coating may be either an ultraviolet coating or a water base coating depending on the requirements of each coating job. The material used to form the dipping and intermediate rollers 30 and 28 is not critical so long as the coating is supplied and evenly distributed on the applicator roller 12. Also, it is possible to replace the supply means 26, 28 and 30 with any known supply means capable of supplying coating from a source to the applicator roller 12.

A similar supply means is employed for supplying either water or coating to the back-up roller 14. The back-up roller supply means includes a second intermediate roller 32 which is interposed between the back-up roller 14 and a dipping roller 34 positioned in a supply 36 of either water or coating. The water or coating may be held e.g. in a pan 38 which is easily replaceable so that the apparatus 10 may be converted from one mode of operation to another simply by replacing the pan 38 presently in the apparatus with a pan 38 containing the fluid necessary for the desired operation. Therefore, it is not necessary to replace or move any of the rollers when converting the apparatus 10 between modes. This represents a significant savings in down time and enables the apparatus 10 to be quickly converted between one and two side coating operations.

The web 24 entering the couple formed by the applicator and back-up rollers 12 and 14 has wet ink on at least one side thereof and may even have wet ink on both sides thereof. The web 24 is not dried prior to entering the coating apparatus 10 since a drying operation must be conducted after the coating operation and a drying step prior to the coating operation would represent an unnecessary repetition of operations. It is noted that, although the inventive coating apparatus is used with webs having wet ink on one or both sides thereof, that it may also be employed with dry webs without suffering any disadvantage to known devices.

As the web 24 passes through the roller couple, the one side thereof facing the applicator roller 12 is coated with coating supplied to the applicator roller 12. Depending on the mode of operation, the other side of the web 24 which faces the back-up roller 14 is either coated or comes in contact with a film of water carried by the back-up roller 14 by its hydrophilic surface. This film of water separates the web 24 and the ink thereon from the back-up roller 14 to prevent smudging of the ink and to prevent the ink from being offset to the surface of the back-up roller 14. Some of the water is transferred to the coated web 40 leaving the couple and is quickly evaporated during the subsequent drying operation.

The one and two side coating modes of operation of the apparatus 10 will now be described with reference to FIGS. 2 and 3 of the drawing.

One side coating is performed in a first mode of the invention as shown in FIG. 2. In this mode, coating 42 is supplied to the coating applicator roller 12 from a coating supply such as through dipping roller 30 and first intermediate roller 28 shown in FIG. 1. The back-up roller 14 is supplied with water from a water supply 36 through second dipping roller 34 and second intermediate roller 32. Due to the hydrophilic characteristic of the back-up roller 14, the water is attracted to the roller so as to form a film 44 thereon. As the web 24 is passed through the couple created between the applicator and back-up rollers 12 and 14, wet ink on the side of the web facing the back-up roller comes into contact with the water film 44 and is separated thereby from the back-up roller surface. This prevents offset to the back-up roller surface as well as preventing smudging which can result from such offset. Some of the water 46 forming the film is transferred to the web 24 during the coating operation. However, this water 46 is quickly evaporated during the subsequent drying operation.

In the second mode of operation, a two side coating may be performed. As shown in FIG. 3, the web 24 passing through the roller couple is coated on both sides thereof. The applicator roller 12 is again supplied with coating 42 through first dipping and intermediate rollers 30 and 28 shown in FIG. 1, which engage the applicator roller 12. The back-up roller 14 is supplied with coating 48 through the same second dipping and intermediate rollers 34 and 32 employed in the first mode of operation and shown in FIG. 1. As the web 24 passes through the couple, coating is applied to both surfaces of the web 24 and offset does not occur due to the affinity of the coating 42 and 48 for the surface of the web 24.

The applicator and back-up rollers 12 and 14 may be driven in a direction opposite to the direction of web travel which is indicated by the arrow 50, and opposite to the direction illustrated by arrows 52 and 54, during either the one or two side coating operations so as to apply more coating material on the web and to press the coating into the web. This results in a printed web having an improved texture which is protected from scuffing and which has an enhanced appearance.

A turning roller arrangement according to an embodiment of the invention is illustrated in FIG. 4. A web 60 passes through a first ink application operation whereat ink is applied by an ink applying roller 62 which is backed up by a backup roller 64. After passing through the operation, the web 60 is turned by a conventional turning roller 66 that contacts a side of the web which is free of ink. The web 60 then passes over a turning roller 68 having a hydrophilic surface, such as a hard chrome finish with a hydrophilic etch, which has been supplied with water so that a layer of water forms between the wet ink on the web and the surface of the turning roller 68. The water is supplied to the turning roller 68 by a water applicator roller 70 which is in contact with a water supply 72. By this construction, none of the ink is transferred to the roller 68 and thus, there is no smudging of the ink on the web 60. Thus, it is possible to reliably guide the web 60 from one coating or printing operation into another without a concern for smudging of the fresh ink on the web.

While this invention has been illustrated and described in accordance with a preferred embodiment, it is recognized that variations and changes may be made and equivalents employed herein without departing from the invention as set forth in the claims.

What is claimed is:

1. A method for sequentially performing one-sided and two-sided coating of webs having wet ink thereon comprising:

supplying coating to a coating applicator roller, supplying water to a back-up roller forming a couple with said coating applicator roller and having a surface which is hydrophilic and is hard relative to said coating applicator roller, feeding a web having wet ink thereon between said applicator roller and said back-up roller so that coating is applied to one side of the web and water on the surface of said back-up roller separates the other side of the web from said back-up roller thus preventing ink on the web from contacting said back-up roller, changing the supply to the back-up roller from water to coating, supplying coating to the back-up roller, and feeding web having wet ink thereon between said applicator roller and said back-up roller so that coating is applied to both sides of said web.

2. A method for selectively providing one and two-sided coating of webs having wet ink thereon comprising the steps of:

providing a coating applicator roller having an applicator roller surface;

providing a back-up roller forming a couple with said applicator roller and having a back-up roller surface which repels ink and is hard relative to said applicator roller surface;

supplying a moving web to said couple, the web having ink thereon which is wet when the web is received at the couple;

driving said applicator roller;

driving said back-up roller;

supplying coating to said applicator; and selecting the fluid to be supplied to the back-up roller so that water is supplied to said back-up roller when one side coating operation is being performed to prevent wet ink on the web from being smudged by the back-up roller, and so that coating is supplied to said back-up roller when a simultaneous two side coating operation is being performed at the couple.

3. The coating method according to claim 2, wherein said applicator and back-up rollers are driven in the direction of movement of the web.

4. The coating method according to claim 2, wherein said applicator and back-up rollers are driven in a direction opposite to the direction of movement of the web.

5. A method for one sided-coating of webs having wet ink thereon comprising the steps of:

providing a coating applicator roller;

providing a back-up roller forming a couple with said applicator roller;

supplying coating to said coating applicator roller;

supplying water to a roller surface of said back-up roller;

supplying a web to said couple, the web having ink thereon which is wet when the web is received at the couple; and driving said applicator and back-up rollers to apply a coating on one side of the web.

6. The coating method according to claim 5, wherein said applicator and back-up rollers are driven in the direction of travel of the web.

7. The coating method according to claim 6, wherein said applicator and back-up rollers are driven in a direction opposite to the direction of travel of the web.

* * * * *